US008279133B2

(12) United States Patent
Shimoda et al.

(10) Patent No.: US 8,279,133 B2
(45) Date of Patent: Oct. 2, 2012

(54) ANTENNA DEVICE

(75) Inventors: Hideaki Shimoda, Tokyo (JP); Tetsuya Shibata, Tokyo (JP); Kei Suzuki, Tokyo (JP)

(73) Assignee: TDK Corporation, Tokyo (JP)

( * ) Notice: Subject to any disclaimer, the term of this patent is extended or adjusted under 35 U.S.C. 154(b) by 274 days.

(21) Appl. No.: 12/712,503

(22) Filed: Feb. 25, 2010

(65) Prior Publication Data

US 2010/0220030 A1 Sep. 2, 2010

(30) Foreign Application Priority Data

Feb. 27, 2009 (JP) ..... 2009-047386

(51) Int. Cl.
*H01Q 1/50* (2006.01)
*H01Q 1/38* (2006.01)

(52) U.S. Cl. ..... 343/860; 343/700 MS; 343/702; 343/829; 343/846

(58) Field of Classification Search ..... None
See application file for complete search history.

(56) References Cited

U.S. PATENT DOCUMENTS

| | | | | |
|---|---|---|---|---|
| 6,531,983 | B1 * | 3/2003 | Hirose et al. | 343/700 MS |
| 6,614,398 | B2 * | 9/2003 | Kushihi et al. | 343/700 MS |
| 7,973,720 | B2 * | 7/2011 | Sorvala | 343/700 MS |
| 8,004,470 | B2 * | 8/2011 | Sorvala et al. | 343/700 MS |
| 2003/0006936 | A1 | 1/2003 | Aoyama et al. | |
| 2004/0169606 | A1 * | 9/2004 | Sato et al. | 343/702 |
| 2007/0171131 | A1 * | 7/2007 | Sorvala et al. | 343/700 MS |
| 2010/0225542 | A1 * | 9/2010 | Suzuki et al. | 343/700 MS |
| 2011/0001672 | A1 * | 1/2011 | Harihara | 343/702 |

FOREIGN PATENT DOCUMENTS

| | | | |
|---|---|---|---|
| EP | 1 146 589 | A1 | 10/2001 |
| EP | 1 267 441 | A2 | 12/2002 |
| JP | 11-340726 | | 12/1999 |
| JP | 11-340726 | A | 12/1999 |
| JP | 2003-069330 | | 3/2003 |
| JP | 2005-236534 | | 9/2005 |
| JP | 2006-340368 | | 12/2006 |
| JP | 2008-252156 | A | 10/2008 |
| WO | WO 2005/078860 | A1 | 8/2005 |
| WO | WO 2006/000650 | A1 | 1/2006 |

OTHER PUBLICATIONS

Extended European Search Report issued in European Patent Application No. 10001961.1, dated Mar. 29, 2010.

* cited by examiner

*Primary Examiner* — Trinh Dinh
(74) *Attorney, Agent, or Firm* — McDermott Will & Emery LLP

(57) ABSTRACT

An antenna device is provided with an antenna element including a base, an inductance adjustment pattern that is formed on the upper surface and a side surface of the base and has a substantially U-shape, a capacitance adjustment pattern that is formed on the upper surface of the base and is placed to face the inductance adjustment pattern, and first to third terminal electrodes provided on the bottom surface of the base. The antenna element is installed between the first side and the second side of the ground pattern that form the two facing sides of the antenna mounting region. One end of the inductance adjustment pattern is connected to the feed line, the other end of the inductance adjustment pattern is connected to the first side of the ground pattern, and the third terminal electrode is connected to the second side of the ground pattern.

9 Claims, 12 Drawing Sheets

ANTENNA DEVICE

RELATED APPLICATIONS

This application is based upon and claims the benefit of priority under 35 U.S.C. 119 from an application Japan 2009-047386 filed on Feb. 27, 2009, the contents of which are incorporated herein by reference.

TECHNICAL FIELD

The present invention relates to an antenna device, and more particularly relates to a surface-mounted antenna device that is built in a small-size portable terminal such as a mobile-phone.

BACKGROUND OF THE INVENTION

In recent years, a chip antenna for GPS (Global Positioning System) or Bluetooth is built in a small-size portable terminal such as a mobile-phone. A chip antenna of this type is required to be small in size and to facilitate resonance frequency adjustment and impedance matching. This is because the resonance frequency and the input impedance of the chip antenna are affected by the structure of the printed circuit board, various electronic components mounted around the chip antenna, and the housing. Therefore, it is necessary to adjust the resonance frequency and the input impedance for each model.

Particularly, it is very important to facilitate the input impedance adjustment of an antenna for the following reason. When the input impedance does not match a feeder-side impedance, VSWR characteristics of the antenna deteriorate and the antenna cannot exhibit performance inherent in the antenna. To facilitate input impedance matching, Japanese Patent Application Laid-Open No. 11-340726 discloses an antenna device having the following structure. A U-shaped radiation conductor, a ground conductor, and a feeder-to-ground short-circuit conductor are formed on an upper surface of a substrate, a bottom surface thereof, and a side surface thereof, respectively. An inductance value of the feeder-to-ground short-circuit conductor is changed by adjusting a branching point of the feeder-to-ground short-circuit conductor, thereby adjusting an input impedance of the antenna.

Meanwhile, Japanese Patent Application Laid-open No. 2006-340368 discloses an antenna device that can efficiently create an electromagnetic field between an antenna and a ground conductor. This antenna device has a trio-land structure in which a dielectric block is provided in a region surrounded by a ground conductor pattern at three sides, one side of the ground conductor is connected to the opposite side of the ground conductor by the dielectric block, and power is supplied via an input pad provided at the bottom surface of the dielectric block.

However, in the conventional antenna device disclosed in Japanese Patent Application Laid-open No. 11-340726, a ground conductor is formed on the bottom surface of the base, and the antenna device is provided only with the base made of a dielectric material. Therefore, to form a $\lambda/4$ radiation conductor required for an antenna operation, there is a need to prepare a sufficiently large base, even with a wavelength shortening effect of the dielectric material being taken into consideration.

The conventional antenna device disclosed in Japanese Patent Application Laid-open No. 2006-340368 has a trio-land structure to efficiently generate an electromagnetic field between a dielectric block and a ground electrode. However, there is a demand for a novel structure to efficiently create an electromagnetic field, other than a trio-land structure. Also, in this antenna device, impedance matching is performed by adjusting the distance between the input pad and the first land pad. As a result, there is a limit to the adjustable impedance range.

SUMMARY OF THE INVENTION

Therefore, the object of the present invention is to provide an antenna device that does not have a particular structure such as a trio-land structure, that is capable of efficiently generating an electromagnetic field between the conductor pattern formed on the surface of a base made of a dielectric material and the ground pattern surrounding the conductor pattern, facilitates resonance frequency adjustment and input impedance adjustment, and accordingly, is capable of improving its antenna characteristics.

To solve the above problems, an antenna device according to the present invention includes an antenna element and a printed circuit board on which the antenna element is mounted. The antenna element includes: a base that is made of dielectric material and has substantially rectangular parallelepiped shape; an inductance adjustment pattern that is formed on the upper surface and a side surface of the base, and has a substantially U-shape; a capacitance adjustment pattern that is formed on the upper surface of the base, and is placed to face the inductance adjustment pattern via a gap with a predetermined width; first and second terminal electrodes that are provided at one end of the bottom surface of the base in the longitudinal direction; and a third terminal electrode that is provided at the other end of the bottom surface in the longitudinal direction. The printed circuit board includes: an insulating substrate; an antenna mounting region that is a substantially rectangular insulating region provided on the insulating substrate in contact with an edge of a long side of the insulating substrate; a ground pattern that is formed on a surface of the insulating substrate so as to define the three sides of the antenna mounting region excluding a side having the edge; a feed line that is led into the antenna mounting region along the edge; first to third lands that correspond to the first to third terminal electrodes, and are provided in the antenna mounting region; and a ground clearance region that is free of conductor patterns, and is formed on a bottom surface and an inner layer of the insulating substrate located immediately below the antenna mounting region. The antenna element is installed between the first side and the second side of the ground pattern that form the two facing sides of the antenna mounting region. One end of the inductance adjustment pattern is connected to the feed line via the first terminal electrode and the first land, and the other end of the inductance adjustment pattern is connected to the first side of the ground pattern on the lead-in side of the feed line via the second terminal electrode and the second land. The third terminal electrode is connected to the second side of the ground pattern.

According to the present invention, the entire printed circuit board including the antenna element and the ground pattern formed on the printed circuit board is caused to function as an antenna, and the antenna element mounted in this manner is caused to function as a LC adjustment element. Particularly, the loop formed with the inductance adjustment pattern is folded at the feed line, and is returned to the ground pattern at the same location. Accordingly, an inductance can be efficiently generated. With this arrangement, it is unnecessary to prepare an impedance matching circuit, and the inductance and capacitance can still be adjusted independently of one another. In this manner, the antenna resonance frequency and the input impedance can be easily adjusted.

In the present invention, the inductance adjustment pattern includes: a first conductor pattern that is formed on the upper surface of the base, and is positioned to face the capacitance adjustment pattern via a gap; a second conductor pattern that is formed on the first side surface perpendicular to the longitudinal direction of the base, has its one end connected to the first conductor pattern, and has the other end connected to the first terminal electrode; and a third conductor pattern that is formed on the first side surface of the base, has its one end connected to the first conductor pattern, and has the other end grounded. The loop formed with the first through third conductor patterns forms an inductance, and it is preferable to adjust the inductance by changing the shape of the loop. Where the inductance adjustment pattern has such a structure, the input impedance of the antenna can be easily adjusted simply by changing the shape of the inductance adjustment pattern, without a large change in resonance frequency.

In the present invention, the capacitance adjustment pattern includes a substantially U-shaped capacitance adjustment pattern that is formed along three sides of the upper surface of the base. The gap between the capacitance adjustment pattern and the first conductor pattern of the inductance adjustment pattern forms a capacitance, and it is preferable to adjust the capacitance by changing the shape of the capacitance adjustment pattern. Where the capacitance adjustment pattern has the above described structure, the resonance frequency of the antenna can be easily changed simply by changing the shape of the capacitance adjustment pattern.

In the present invention, the antenna mounting region has its long sides in a direction perpendicular to the longitudinal direction of the printed circuit board, and the aspect ratio (the horizontal to vertical ratio) of the antenna mounting region is preferably 1.5 or higher. Where the aspect ratio of the antenna mounting region is 1.5 or higher, the current flowing in the center portion of the printed circuit board can be increased, and the antenna radiation efficiency can be made higher.

In the present invention, the antenna mounting region is preferably placed within a range of ±25% from a center of the printed circuit board in the longitudinal direction. According to the present invention, in the antenna device having an antenna mounting structure of the so-called ground clearance type, a balance can be maintained between the currents flowing in the ground face on the printed circuit board. Accordingly, electromagnetic waves can be radiated from the entire printed circuit board including the antenna element, and high radiation efficiency can be achieved with an ultraminiature antenna.

As described above, the present invention can provide an antenna that is capable of efficiently creating an electromagnetic field between the conductor pattern formed on the surface of a base made of a dielectric material and a ground pattern surrounding the conductor pattern, facilitates resonance frequency adjustment and input impedance matching, and is capable of improving its antenna characteristics.

BRIEF DESCRIPTION OF THE DRAWINGS

The above and other objects, features and advantages of this invention will become more apparent by reference to the following detailed description of the invention taken in conjunction with the accompanying drawings, wherein:

FIG. 5A shows a layout of the upper surface 20*a* of the printed circuit board 20, and FIG. 5B shows a layout of the bottom surface 20*b* of the printed circuit board 20;

FIG. 11A is a result of the measurement of the return loss, and FIG. 11B is the result of the measurement of the radiation efficiency; FIG. 12A is a result of the measurement of the return loss, and FIG. 12B is the result of the measurement of the radiation efficiency.

DETAILED DESCRIPTION OF THE EMBODIMENTS

Preferred embodiments of the present invention will be described in detail hereinafter with reference to the accompanying drawings.

Figure 1:
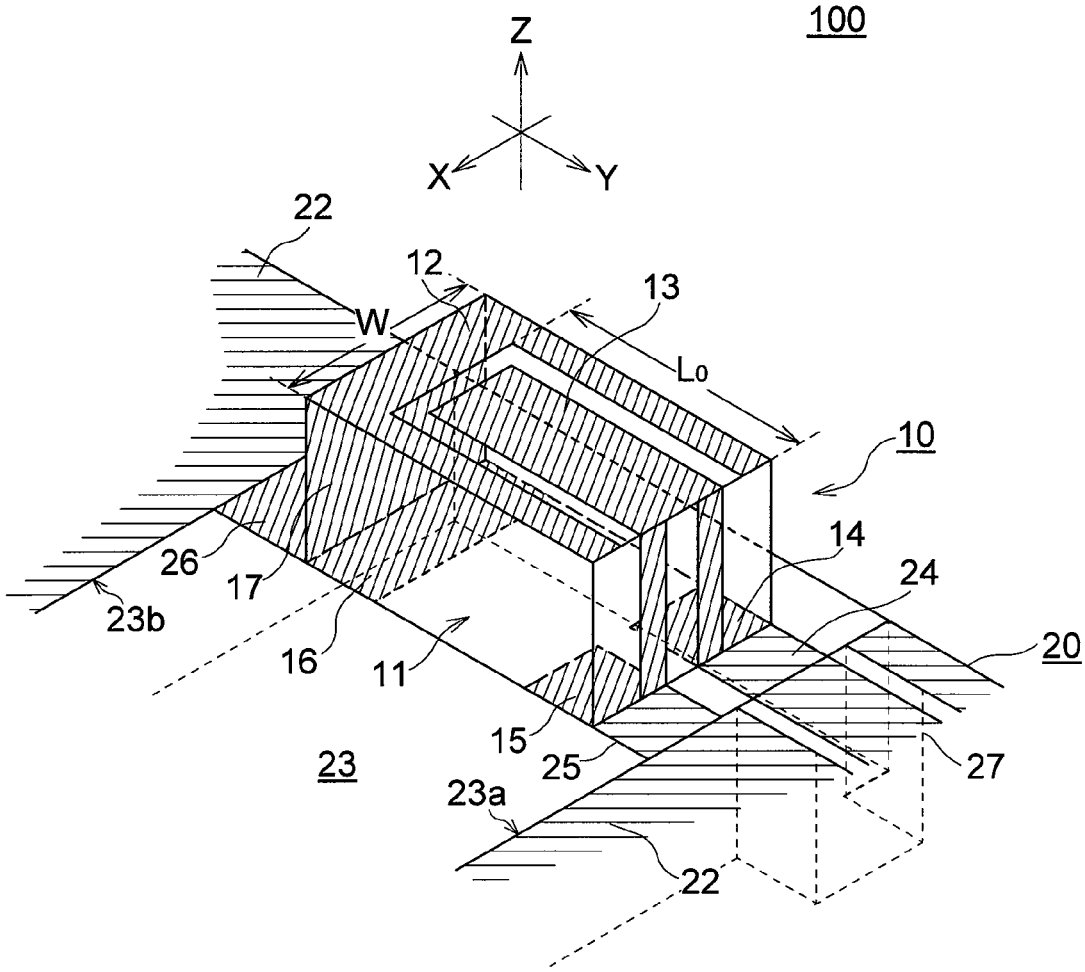
FIG. 1 is a schematic perspective view of a configuration of an antenna device 100 according to a first embodiment of the present invention.
Figure 2:
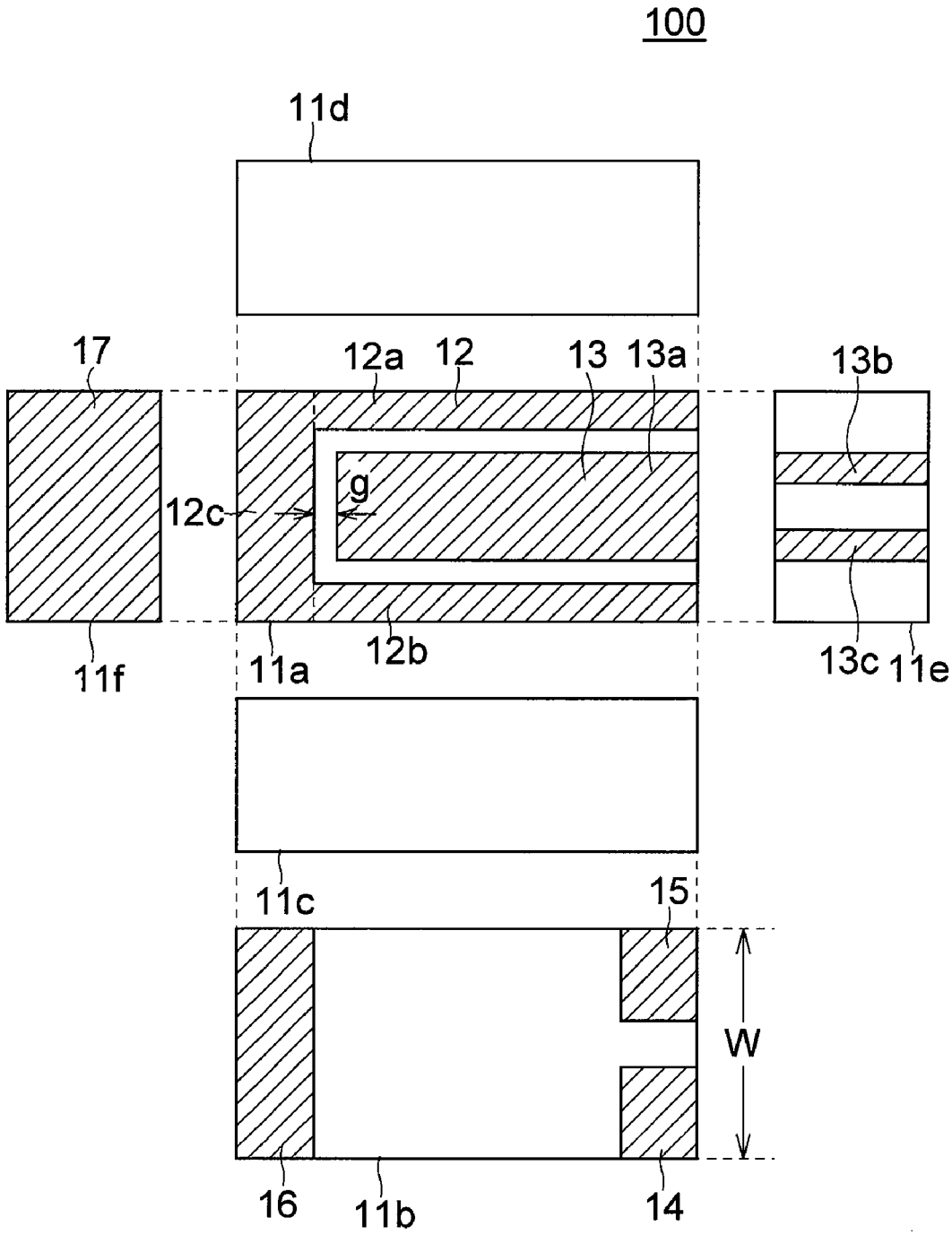
FIG. 2 is a development view of an antenna element 10.

FIG. 1 is a schematic perspective view showing a configuration of an antenna device 100 according to a first embodiment of the present invention. FIG. 2 is a development view of an antenna element 10.

As shown in FIG. 1, the antenna device 100 according to this embodiment includes the antenna element 10 and a printed circuit board 20 on which the antenna element 10 is mounted. The antenna element 10 is mounted in an antenna mounting region 23 provided on one principal surface (an upper surface) of the printed circuit board 20. The antenna device 100 according to this embodiment does not perform an antenna operation only with the antenna element 10, but rather performs an antenna operation in cooperation with a ground pattern on the printed circuit board 20. In this sense, the antenna element 10 may be a LC adjustment element for adjusting an inductance component (L) and a capacitance component (C) of the entire antenna device including the printed circuit board 20.

The antenna element 10 includes a base 11 made of dielectric material and a plurality of conductor patterns formed on the base 11. The base 11 has rectangular parallelepiped shape, with its longitudinal direction being the Y-direction. Among surfaces of the substrate 11, an upper surface 11*a*, a bottom surface 11*b*, and two side surfaces 11*c* and 11*d* are parallel to the Y-direction. Side surfaces 11*e* and 11*f* of the base 11 are perpendicular to the Y-direction. The bottom surface 11*b* is the mounting face with respect to the printed circuit board 20. A vertical direction of the antenna element 10 is defined by the principal surface of the printed circuit board 20 set as a reference surface.

The material of the base 11 is not particularly limited. Examples of the materials include Ba—Nd—Ti (80 to 120 in relative permittivity), Nd—Al—Ca—Ti (43 to 46 in relative permittivity), Li—Al—Sr—Ti (38 to 41 in relative permittivity), Ba—Ti (34 to 36 in relative permittivity), Ba—Mg—W (20 to 22 in relative permittivity), Mg—Ca—Ti (19 to 21 in relative permittivity), sapphire (9 to 10 in relative permittivity), alumina ceramics (9 to 10 in relative permittivity), cordierite ceramics (4 to 6 in relative permittivity), and the likes. The base 11 is produced by burning powder of those materials with the use of a mold.

The dielectric material can be appropriately selected in accordance with the target frequency. When a relative permittivity $\in_r$ is higher, greater wavelength reduction effect can be obtained and a radiation conductor can be made shorter. In this case, however, radiation efficiency deteriorates. Therefore, high relative permittivity $\in_r$ is not always appropriate but there is an appropriate relative permittivity for the target frequency. When the target frequency is 2.4 GHz, for example, it is preferable to use a material with relative permittivity $\in_r$ of approximately 5 to 30 for the base 11. By using such a material, the base 11 can be made smaller in size while securing sufficient radiation efficiency. As a material having a relative permittivity $\in_r$ of about 5 to 30, it is preferable to use, for example, Mg—Ca—Ti dielectric ceramic. As the Mg—Ca—Ti dielectric ceramic, it is particularly preferable to use the Mg—Ca—Ti dielectric ceramic containing $TiO_2$, MgO, CaO, MnO, and $SiO_2$.

As shown in FIG. 2, the conductor patterns on the antenna element 10 includes a capacitance adjustment pattern 12 formed on the upper surface 11*a* of the base 11, an inductance adjustment pattern 13 integrally formed across the side surface (the first side surface) 11*e* to the upper surface 11*a* of the base 11, terminal electrodes 14 to 16 formed on the bottom surface 11*b* of base 11, and a ground conductor 17 formed on a side surface 11*f* of the base 11. At least the capacitance adjustment pattern 12 and the inductance adjustment pattern 13 form a conductor pattern (the antenna characteristics adjustment pattern) to adjust the antenna characteristics. Those conductor patterns can be formed by applying a conductive paste by a technique such as screen printing or transfer printing, and baking the conductive paste under a predetermined temperature condition. The conductive paste may be silver, silver-palladium, silver-platinum, copper or the like. Alternatively, the conductor patterns may be formed by plating, sputtering or the like.

The capacitance adjustment pattern 12 is a substantially U-shaped conductor pattern formed on the upper surface 11*a* of the base 11. The capacitance adjustment pattern 12 includes strip conductor patterns 12*a* and 12*b* extending along the two long sides of the upper surface 11*a*, and a strip conductor pattern 12*c* extending along the short side shared with the side surface 11*f*. One end of each of the strip conductor patterns 12*a* and 12*b* is connected to either end of the strip conductor pattern 12*c*, and the other end of each of the strip conductor patterns 12*a* and 12*b* is an open end. The open ends of the strip conductor patterns 12*a* and 12*b* extend to the Y-direction end portion of the base 11. Accordingly, the capacitance generated by the electrostatic capacitance adjustment pattern 12 can be maximized. However, when there is no need to maximum the capacitance, the open ends may be located in more inside positions than the Y-direction end portion of the base 11.

Figure 3:
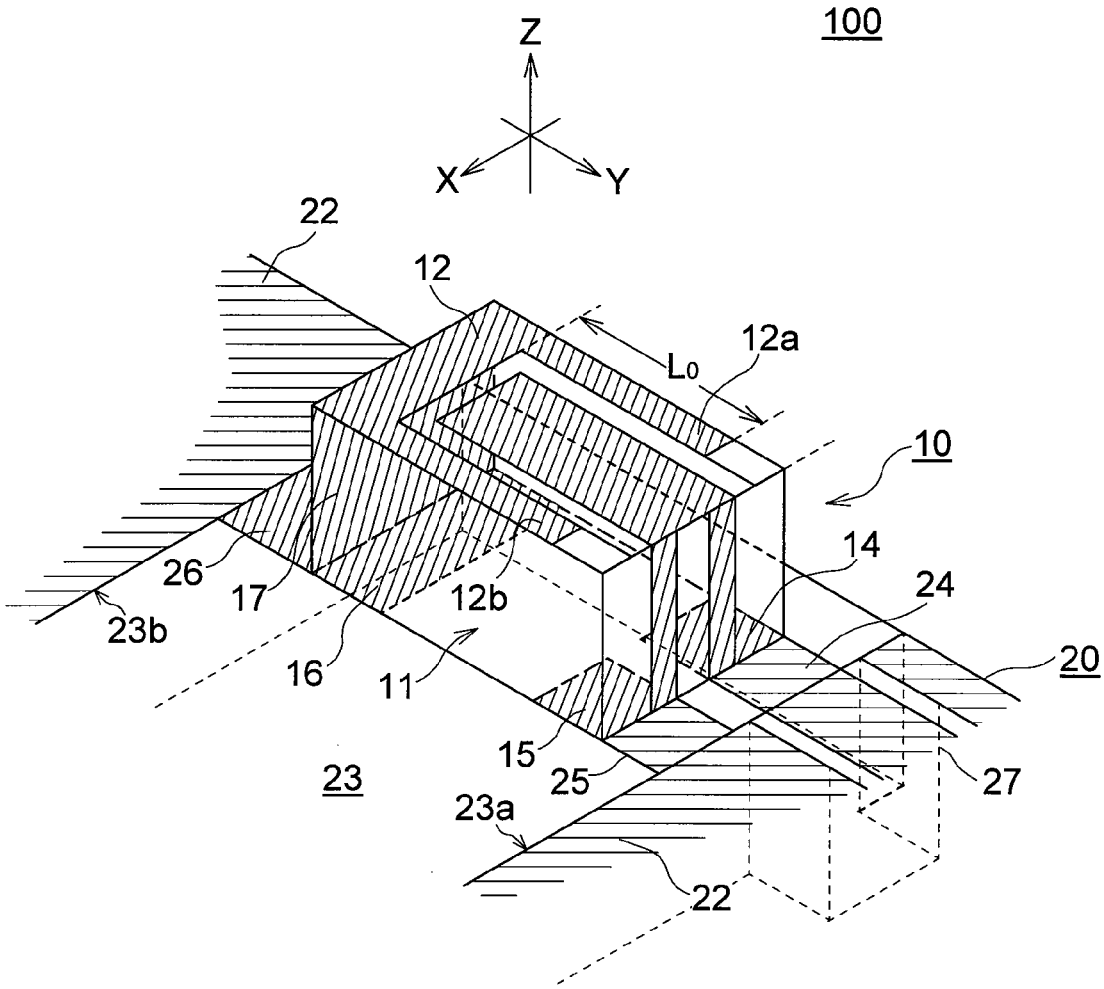
FIG. 3 is a schematic perspective view showing the statement in which the length of the sides of the capacitance adjustment pattern 12 or the length L0 of the first and second strip conductor patterns 12*a* and 12*b* are reduced.

The inductance adjustment pattern 13 includes a rectangular conductor pattern (the first conductor pattern) 13*a* formed on the upper surface 11*a* of the base 11, and two parallel linear conductor patterns (the second and third conductor patterns) 13*b* and 13*c* formed on the side surface 11*e* of the base 11. Those conductor patterns form a substantially U-shaped conductor pattern. One end of the linear conductor pattern 13*b* is connected to one width-direction end of the rectangular conductor pattern 13*a*, and the other end of the linear conductor pattern 13*b* is connected to the terminal electrode 14. One end of the linear conductor pattern 13*c* is connected to the other width-direction end of the rectangular conductor pattern 13*a*, and the other end of the linear conductor pattern 13*c* is connected to the terminal electrode 15. The three sides of the rectangular conductor pattern 13*a*, exclusive of the side connected to the second and third conductor patterns 13*b* and 13*c*, are placed to face the substantially U-shaped capacitance adjustment pattern via a gap g having a uniform width. With this arrangement, a capacitance is formed between the capacitance adjustment pattern 12 and the rectangular conductor pattern 13*a*, and accordingly, the two patterns can be electromagnetically coupled. To reduce the capacitance, the length of the sides of the capacitance adjustment pattern 12 or the length L0 of the first and second strip conductor patterns 12*a* and 12*b* should be reduced, as shown in FIG. 3.

Figure 4:
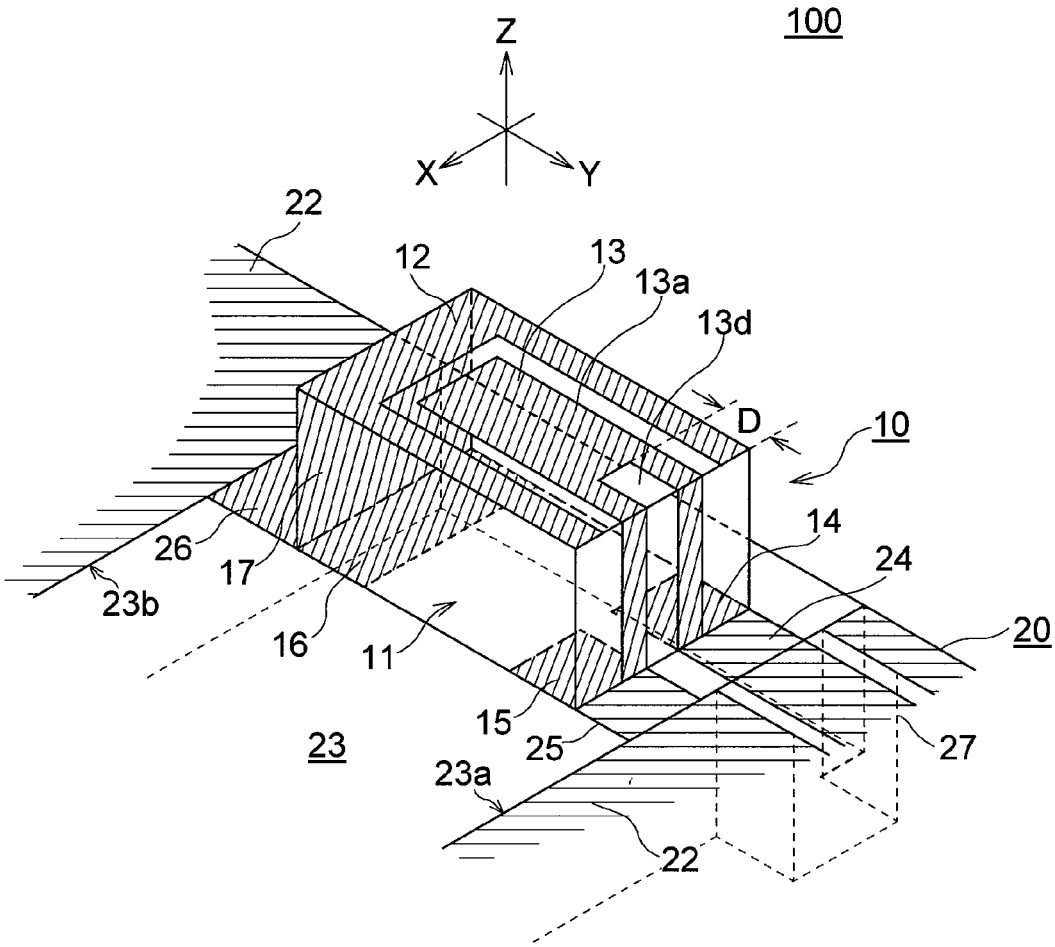
FIG. 4 is a perspective view showing the statement in which a notch 13*d* is formed in the rectangular conductor pattern 13*a* of the inductance adjustment pattern 13.

The inductance adjustment pattern 13 forms a substantially U-shaped loop, and forms an inductance with this structure. To increase the inductance, the loop size should be made larger. To do so, a notch 13*d* is formed in the rectangular conductor pattern 13*a*, as shown in FIG. 4. The notch 13*d* is an extended portion of the space provided between the linear conductor patterns 13*b* and 13*c*. With this arrangement, the loop size of the substantially U-shaped inductance adjustment pattern 13 becomes larger, and the inductance can be made larger accordingly.

The terminal electrodes 14 to 16 are formed on the bottom surface 11*b* of the base 11. More specifically, the terminal electrodes 14 and 15 are formed at one end of the bottom surface 11*b* in the Y-direction, and the terminal electrode 16 is formed at the other end thereof. The terminal electrode 16 is formed along the entire width direction of the bottom surface 11*b*, and the terminal electrodes 14 and 15 are formed at a predetermined distance from each other in the width direction (X-direction) of the bottom surface 11*b*. That is, when a width of the bottom surface 11*b* is defined as W, a width of the terminal electrode 16 is W, and a width of each of the terminal electrodes 14 and 15 is less than W/2. In this embodiment, any conductor pattern other than the terminal electrodes 14 to 16 is not formed on the bottom surface 11*b* of the base 11, and most of the bottom surface 11*b* of the base 11 is an insulating region.

The ground conductor 17 is formed on the entire surface of the side surface (the second side surface) 11*f* of the base 11, and has its upper end connected to the capacitance adjustment pattern 12. With this arrangement, the capacitance adjustment pattern 12 and the ground conductor 17 form an integral conductor pattern, and the capacitance adjustment pattern 12 is connected to the terminal electrode 16 via the ground conductor 17.

Those conductor patterns formed on the respective surfaces of the base 11 are preferably formed to be bilaterally symmetric about a plane in parallel to the side surfaces 11*c* and 11*d* of the base 11. By forming these conductor patterns in this way, even if the antenna element 10 is rotated by 180 degrees about an axis perpendicular to the upper and bottom surfaces of the base 11 (the Z-axis), the conductor pattern arrangement of the antenna element 10 viewed from the edge of the printed circuit board 20 is substantially the same in shape as those that are not rotated. Accordingly, the antenna characteristics do not greatly vary with the orientation of the antenna element 10, and the antenna design can be made easier.

Figure 5A:
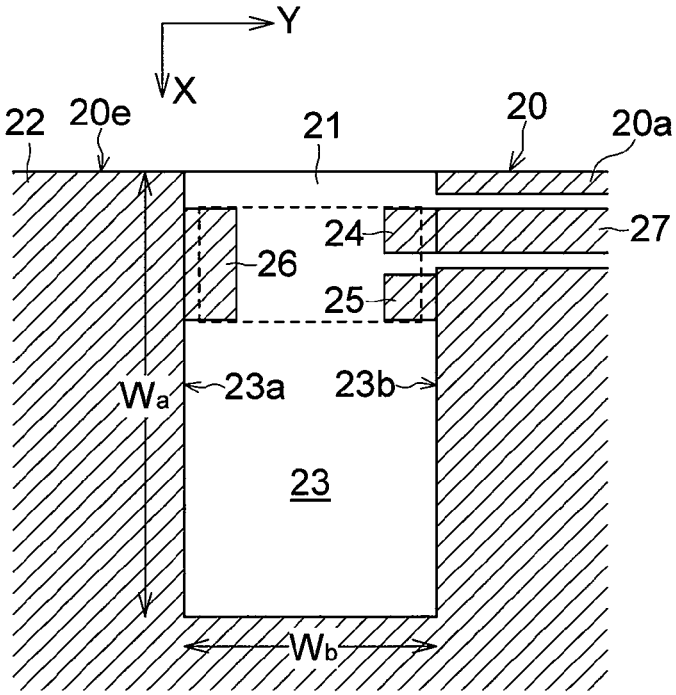
FIGS. 5A and 5B are schematic plan views of the pattern layouts of the printed circuit board 20 on which the antenna element 10 is mounted, specifically
Figure 5B:
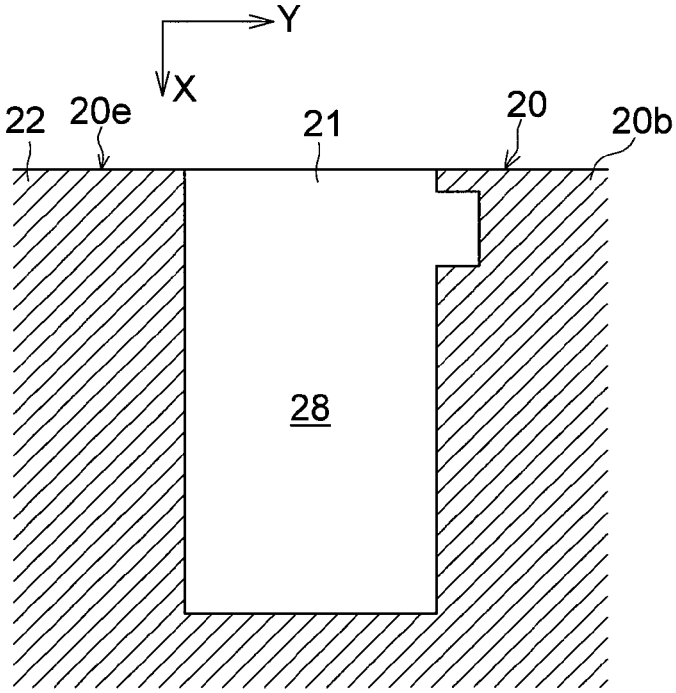

FIGS. 5A and 5B are schematic plan views of the pattern layout of the printed circuit board 20 on which the antenna element 10 is mounted. FIG. 5A shows a layout of the upper surface 20*a* of the printed circuit board 20, and FIG. 5B shows a layout of the bottom surface 20*b* of the printed circuit board 20. Particularly, FIG. 5B transparently shows the layout of the bottom surface 20*b* viewed from the upper surface 20*a* side.

As shown in FIGS. 5A and 5B, the printed circuit board 20 has a conductor patterns formed on the upper and bottom surfaces of the insulating substrate 21. More specifically, the substantially rectangular antenna mounting region 23 having one side in contact with an edge 20*e* of the printed circuit board 20 in the longitudinal direction (the Y-direction) and three other sides defined by a ground pattern 22 is provided on the upper surface 20*a* of the printed circuit board 20. The antenna mounting region 23 is a rectangular insulating region excluding the ground pattern 22, and three lands 24 to 26 are provided in the antenna mounting region 23. If the antenna mounting region 23 is placed on the edge 20*e* of the printed circuit board 20, a half space viewed from the antenna element 10 is a free space in where the printed circuit board (the ground pattern) does not present. This can improve radiation efficiency of the antenna device 100.

The lands 24 to 26 are connected to the terminal electrodes 14 to 16 of the antenna element 10, and have the same widths as those of the corresponding terminal electrodes 14 to 16. The land 24 is connected to a feed line 27, and the lands 25 and 26 are connected to the ground pattern 22 at the nearest locations. With this arrangement of the lands, the antenna element 10 causes short-circuit between the portions of the ground pattern on both sides of the antenna mounting region 23 in the Y-direction, and functions as an LC adjustment element for the entire ground pattern 22.

A ground clearance region 28 that is an insulating region having substantially the same shape as the antenna mounting region 23 on the upper surface 20*a* in a plan view is provided on the bottom surface 20*b* of the printed circuit board 20. Since any component is not mounted on the ground clearance region 28 on the bottom surface 20*b*, any conductor pattern such as a land is not formed in the ground clearance region 28. If the printed circuit board 20 is a multilayer board, it is necessary to form such a ground clearance region 28 not only on the bottom surface 20*b* but also in inner layers. In other words, an insulating region that is free of a ground pattern needs to extend immediately below the antenna mounting region 23. Such a mounting structure is called a "ground clearance type", while a structure having a ground pattern covering the area immediately below the antenna mounting region 23 is called an "on-ground type".

The antenna element 10 is mounted in the antenna mounting region 23 that is wider than a chip antenna formed by partially removing the ground pattern 22 existing on the printed circuit board 20. In the case of a ground clearance type, nothing can be mounted below the antenna element 10, and a large substrate area is ensured. However, since there is no ground surface at all, the height of the antenna (base) can be reduced. In the case of the on-ground type, on the other hand, there is a ground surface on the mounting surface and the region existing below the mounting surface. Although the height of the antenna element is larger than that in the case of a ground clearance type, the bottom surface of the multilayer board can be used as a component mounting region, with the upper surface of the multilayer board being the antenna mounting surface, the inner layer being a ground pattern layer.

The antenna mounting region 23 is a rectangular region that extends in a direction (the X-direction) perpendicular to the longitudinal direction of the printed circuit board 20. Where Wa represents the length of each long side of the antenna mounting region 23, and Wb represents the length of each short side of the antenna mounting region 23, the following relationship is preferably satisfied: $Wa/Wb \geqq 1.5$. More specifically, where the short side length Wb is 3 mm, the long side length Wa is preferably 4.5 mm or greater. By setting the aspect ratio of the antenna mounting region 23 at 1.5 or higher, the current flowing in the center portion of the printed circuit board 20 can be increased. Accordingly, the radiation efficiency of the antenna can be made higher, and more particularly, radiation efficiency of 50% or higher can be secured.

Figure 6:
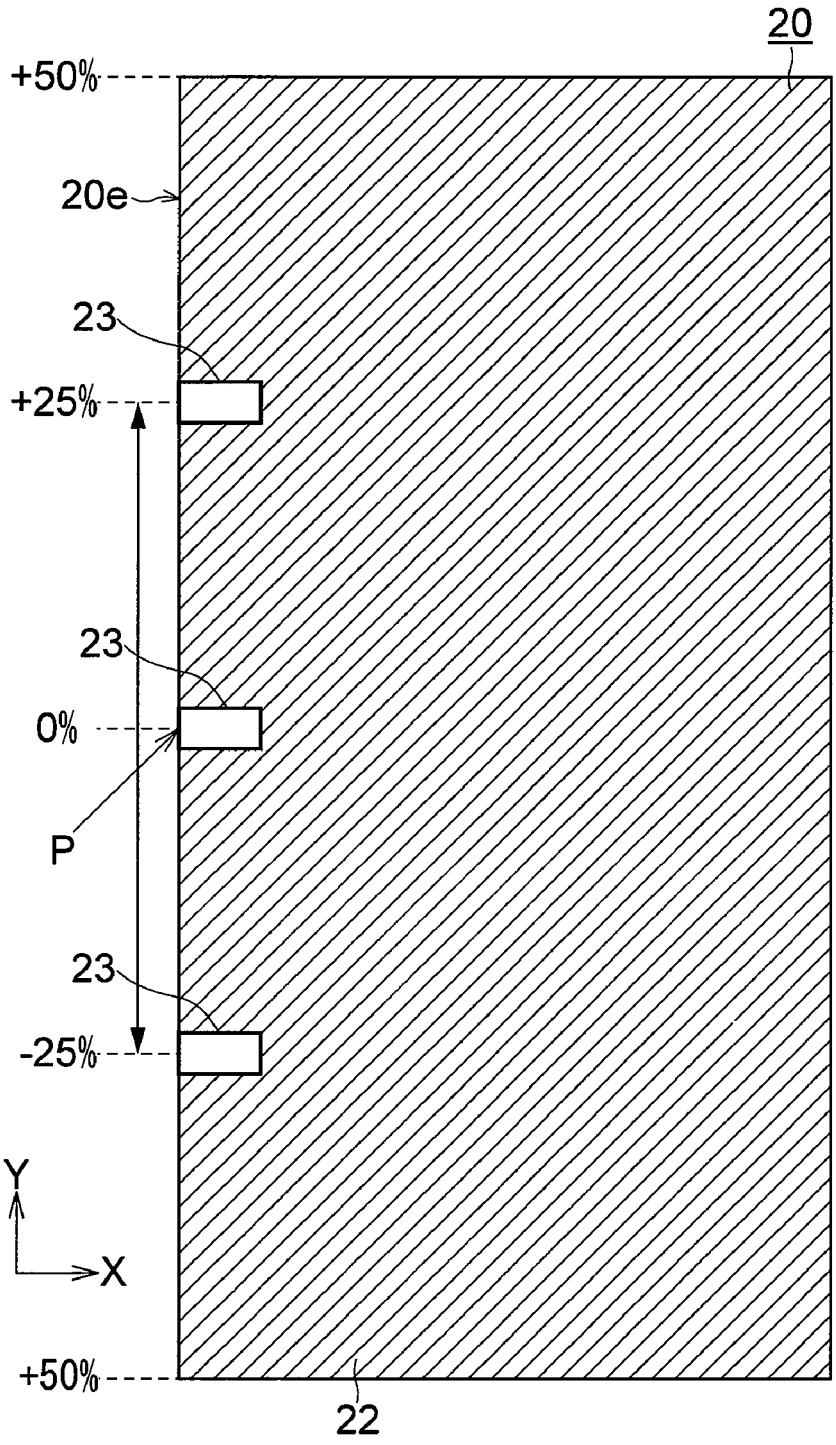
FIG. 6 is a schematic plan view showing a preferred formation position of the antenna mounting region 23.

FIG. 6 is a schematic plan view showing a preferred formation position of the antenna mounting region 23.

As shown in FIG. 6, the antenna mounting region 23 is in contact with the edge 20*e* of the printed circuit board 20 extending in the longitudinal direction (the Y-direction). In this case, the antenna mounting region 23 is provided within the range of ±25% from the midpoint (a reference point) P on the longitudinal direction of the printed circuit board 20. A reference point of the antenna mounting region 23 is the midpoint of the short side of the printed circuit board 20. In this way, when the antenna mounting region 23 is provided within the range of ±25% from the midpoint P of the printed circuit board 20 in its longitudinal direction, a balance can be maintained between the currents flowing in the regions on both sides of the printed circuit board 20 in its longitudinal direction, when seen from the antenna mounting region 23. Accordingly, the radiation efficiency of the antenna can be made higher, and more particularly, radiation efficiency of 50% or higher can be secured.

As shown in FIG. 1, when the antenna element 10 is mounted on the printed circuit board 20, one end of the linear conductor pattern 13*b* branching from the inductance adjustment pattern 13 is connected to the feed line 27 via the land 24, and one end of the linear conductor pattern 13*c* is connected to the ground pattern 22 via the land 25. The lower end of the ground conductor 17 is connected to the ground pattern 22 via the land 26. As a result, the antenna element 10 is mounted on the printed circuit board 20 so as to cause short-circuit between one and the other portion of the ground pattern defining the two opposing sides 23*a* and 23*b* of the antenna mounting region 23.

A feeding current I1 is supplied from the feed line 27 to the inductance adjustment pattern 13 connected to the feed line 27. The feeding current I1 then flows into the ground pattern 22 via the inductance adjustment pattern 13. Since the inductance adjustment pattern 13 on the loop extending from the feed line 27 is connected to the ground pattern 22 extending in the same direction as the feed line 27, an inductance can be efficiently generated. Also, since the rectangular conductor pattern 13*a* of the inductance adjustment pattern 13 is capacitively-coupled to the capacitance adjustment pattern 12 via the gap g, a dielectric current I2 that varies with the feeding current I1 flows into the capacitance adjustment pattern 12.

The dielectric current I2 then flows into the ground pattern 22 on the printed circuit board 20 via the ground conductor 17, and is radiated as an electromagnetic wave from the entire ground pattern.

In the following, the reasons that an electromagnetic field is formed with the use of the entire ground pattern on the printed circuit board 20 are described in detail.

In the case of a Bluetooth antenna, for example, the resonance frequency f is 2.43 GHz (resonance wavelength $\lambda$=12.35 cm), and the required bandwidth BW is 3.5%. Where a Bluetooth antenna having an antenna length L of 2 mm is constituted with the use of a base of 2.0 mm×1.2 mm×1.0 mm, the wavelength ratio (a) of the antenna length L satisfies $a=2\pi L/\lambda=0.1023$. Where the radiation efficiency ($\eta$) is 0.5 ($\eta$=0.5, the radiation efficiency being 50%), the Q factor (Q) satisfies $Q=\eta(1+3a^2)/a^3(1+a^2)=476.8365$. Further, where VSWR(S) is 2 (S=2), the bandwidth (BW) is calculated to be $(s-1)\times 100/(\sqrt{s}Q)$ [%] and BW=0.1%. That is, When the length of the Bluetooth antenna is 2 (L=2), the antenna cannot satisfy the bandwidth 3.5%.

As described above, a very small chip antenna having an antenna length L smaller than $\lambda/2\pi$ is theoretically incapable of achieving antenna characteristics better than those obtained by the above equations with a single antenna element. Therefore, it is quite important for the very small chip antenna to allow the entire ground pattern 22 to efficiently function as an antenna, taking advantage of the current flowing into the ground pattern 22 on the printed circuit board 20.

Figure 7:
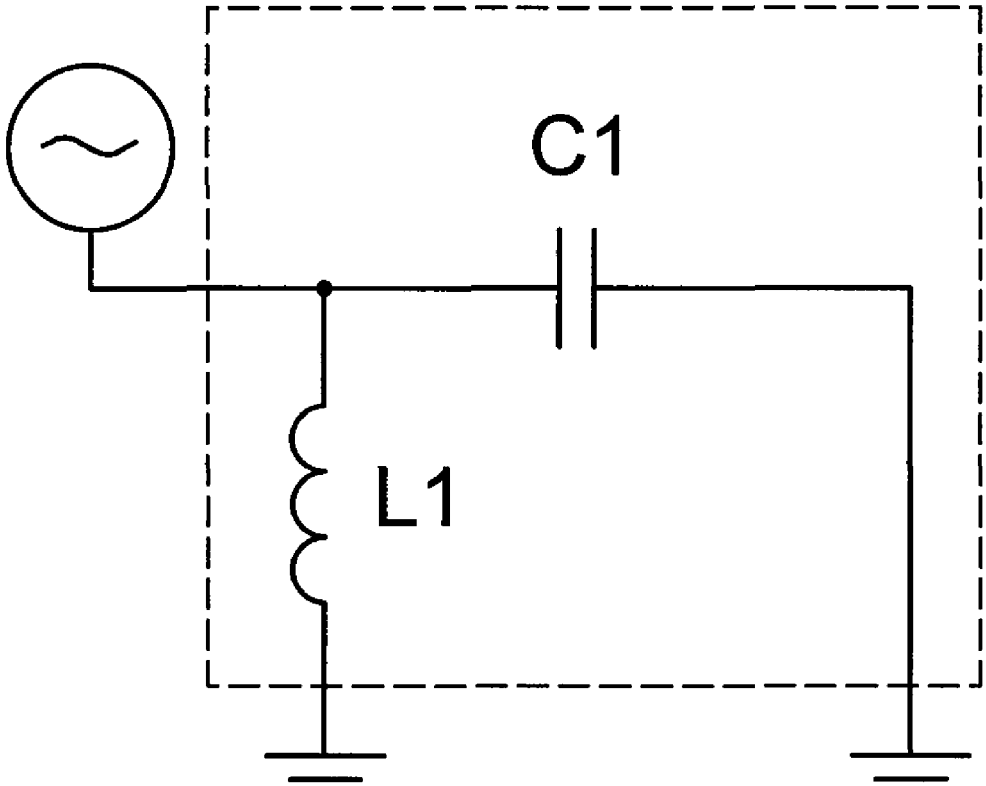
FIG. 7 is an equivalent circuit diagram of the antenna element 10 mounted on the printed circuit board 20.

FIG. 7 is an equivalent circuit diagram of the antenna element 10 mounted on the printed circuit board 20.

As shown in FIG. 7, the antenna element 10 is an LC parallel circuit inserted between a feed line and a ground. The capacitance C1 is formed mainly by the gap g between the capacitance adjustment pattern 12 and the rectangular conductor pattern of the inductance adjustment pattern 13, and the inductance L1 is formed by the loop of the inductance adjustment pattern 13. In this equivalent circuit, the resonance frequency of the antenna can be changed by adjusting the capacitance C1. When the gap width becomes smaller, the capacitance C1 becomes larger, and the resonance frequency becomes lower. When the gap width becomes larger, the capacitance C1 becomes smaller, and the resonance frequency becomes higher. Furthermore, an input impedance of the antenna device 100 can be changed by adjusting the inductance L1 without changing the resonance frequency. When a loop size of the inductance pattern 13 becomes larger, the inductance L1 becomes larger, and the input impedance also becomes larger. When the loop size thereof becomes smaller, the inductance L1 becomes smaller, and the input impedance also becomes smaller.

Figure 8A:
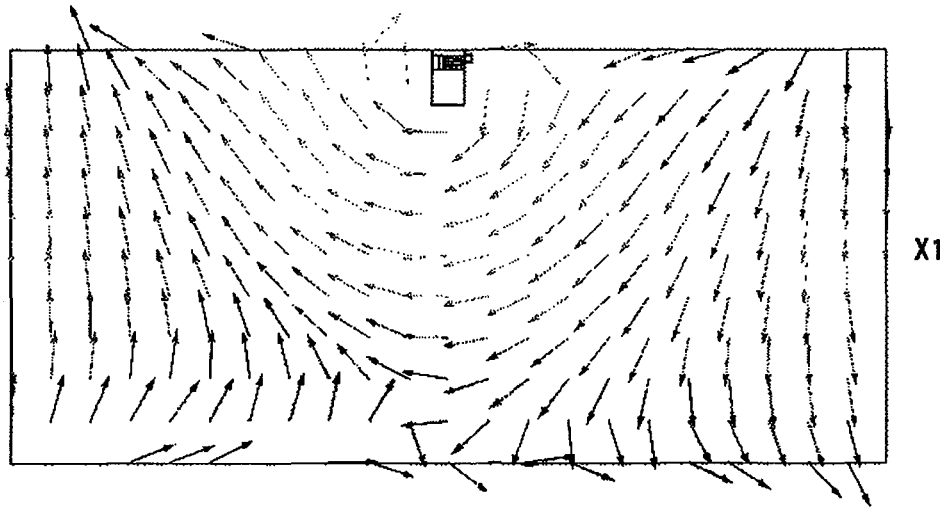
FIGS. 8A to 8C are schematic diagrams showing the results of simulations performed to examine the current distributions on the printed circuit board 20.
Figure 8B:
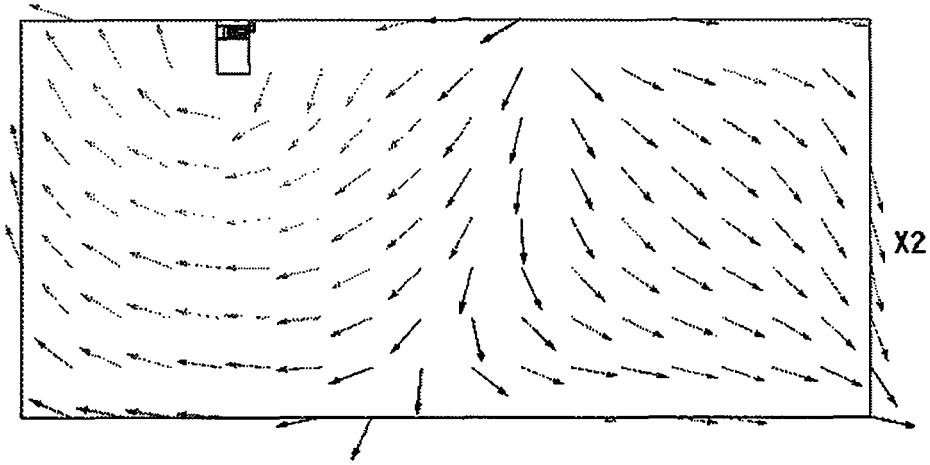
Figure 8C:
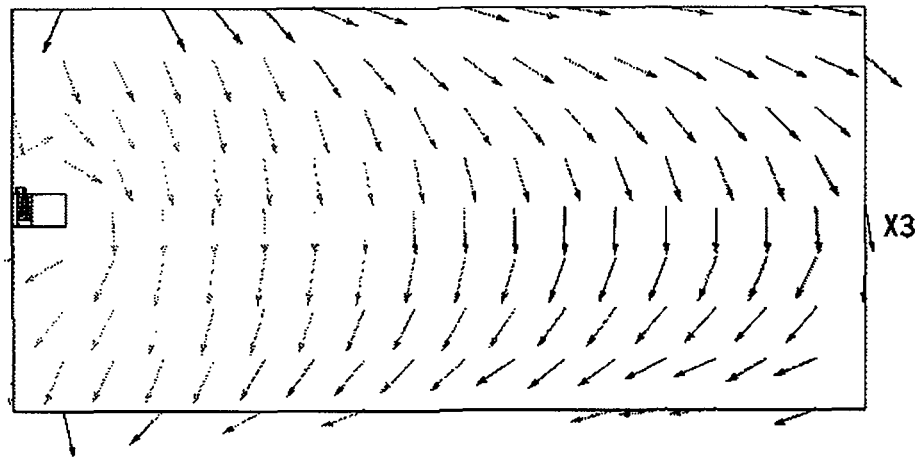

FIGS. 8A to 8C are pattern diagrams showing the results of simulations performed to examine the current distributions on the printed circuit board 20. FIG. 8A shows the result obtained in a case where the antenna mounting region 23 is located at the reference point P (0%) (sample X1), FIG. 8B shows the result obtained in a case where the antenna mounting region 23 is located at the location of −25% (sample X2), and FIG. 8C shows the result obtained in a case where the antenna mounting region 23 is located at the midpoint of the short side of the printed circuit board 20 (sample X3). The printed circuit board 20 to be evaluated through the simulations has a ground pattern formed on the entire substrate surface, except for the antenna mounting region 23. The arrows in the drawings indicate the directions of current flows, and the tones of the arrows indicate the intensities of currents. Darker arrows indicate larger currents, and lighter arrows indicate smaller currents.

As shown in FIG. 8A, when the antenna mounting region 23 is located at the reference point P, the current distribution on the printed circuit board 20 shows that a balance is maintained between the currents floating in the right-side region and the left-side region with respect to the longitudinal direction of the printed circuit board 20 seen from the antenna mounting region 23. Accordingly, the electromagnetic wave can be more efficiently radiated from the entire printed circuit board including the antenna element 10.

On the other hand, as shown in FIG. 8B, when the antenna mounting region 23 is located at the location of −25%, the current distribution on the printed circuit board 20 shows that the current distribution in the left half of the printed circuit board 20 including the antenna mounting region 23 greatly differs from the current distribution in the remaining right half. The intensity of the current is higher in the left half, and is lower in the right half. Since a balance is not maintained between the current flowing in the left-side region and the current floating in the right-side region with respect to the longitudinal direction of the printed circuit board 20 seen from the antenna mounting region 23, a decrease in electromagnetic wave radiation efficiency is easily predicted.

Furthermore, as shown in FIG. 8C, when the antenna mounting region 23 is in contact with a short side of the printed circuit board 20 and is located at the midpoint of the short side, the current distribution maintains a balance between the right-side region and the left-side region seen from the antenna mounting region 23. However, the intensity of the current flowing in regions further away from the antenna mounting region 23 is very low. Therefore, electromagnetic waves are hardly efficiently radiated from the entire substrate, and the radiation efficiency is considered lower than the radiation efficiency achieved in the case illustrated in FIG. 8A.

Figure 9:
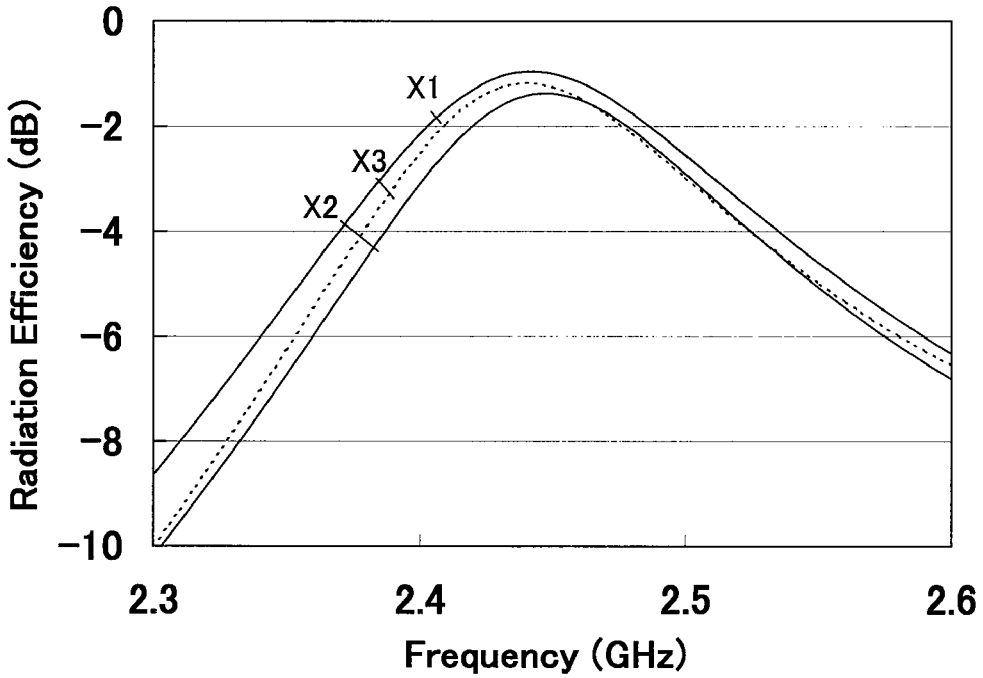
FIG. 9 is a graph showing radiation efficiencies achieved by placing the antenna mounting region 23 at the respective positions illustrated in FIGS. 8A to 8C.

FIG. 9 is a graph showing radiation efficiencies achieved by placing the antenna mounting region 23 at the respective positions illustrated in FIGS. 8A to 8C, respectively.

As shown in FIG. 9, the radiation efficiency of the antenna is the highest in a case of the sample X1 in which the antenna mounting region 23 is at the position shown in FIG. 8A. For example, the radiation efficiency is about 0.8 with a frequency near 2.43 GHz. The radiation efficiency is the second highest and about 0.73 in a case of the sample X3 in which the antenna mounting region 23 is at the position shown in FIG. 8C. The radiation efficiency is the lowest in a case of the sample X2 in which the antenna mounting region 23 is at the position shown in FIG. 8B.

As described above, in the antenna device 100 according to this embodiment, the antenna element 10 is placed within the antenna mounting region 23 that is a ground clearance region on the side of the mounting surface of the printed circuit board 20, and the ground pattern does not exist immediately below the antenna element 10. With this arrangement, the entire printed circuit board 20 including the antenna element 10 can function as an antenna. Particularly, an electromagnetic field can be efficiently created between the conductor pattern formed on the surfaces of the base 11 made of a dielectric material and the ground pattern surrounding the conductor pattern, and accordingly, the antenna characteristics can be improved. To cause the entire printed circuit board to function as an antenna, it is essential to adjust the resonance frequency and the input impedance. In this embodiment, however, such adjustment can be readily and independently performed by changing the shapes of the capacitance adjustment pattern 12 and the inductance adjustment pattern 13 on the antenna element 10.

According to this embodiment, the antenna mounting region 23 is formed with a long rectangular region extending in a direction perpendicular to the longitudinal direction of the printed circuit board 20, and the aspect ratio of the antenna mounting region 23 is 1.5 or higher. Accordingly, the current flowing in the center region of the printed circuit board 20 can be increased, and radiation efficiency of 50% or higher can be secured.

Further, according to this embodiment, the antenna mounting region 23 is in contact with the edge 20*e* extending along the longitudinal direction (y direction) of the printed circuit board 20, and is placed within the range of ±25% from the center point (the reference point) P of the printed circuit board 20 in its longitudinal direction. Accordingly, an electromagnetic field can be more efficiently generated between the conductor pattern formed on the surfaces of the base made of a dielectric material and the ground pattern surrounding the conductor pattern, and the antenna characteristics can be further improved.

Further, according to this embodiment, an antenna mounting structure of a ground clearance type is employed. With this arrangement, even if the height of the base 11 is reduced, the radiation efficiency does not become lower as in the case of an on-ground type. Accordingly, the height of the antenna block can be reduced.

The present invention has thus been shown and described with reference to specific embodiments. However, it should be noted that the present invention is in no way limited to the details of the described arrangements but changes and modifications may be made without departing from the scope of the appended claims.

For example, the base 11 may have a substantially rectangular parallelepiped shape, though the rectangular parallelepiped base 11 is used in the above described embodiment. As long as the above described conductor patterns are formed on the respective surfaces of the base, the corner portions of the base 11 may be cut off, or the base 11 may be partially hollowed out. Also, the printed circuit board 20 may not be a complete rectangular flat board, and may have notches formed at the corners or edges, for example.

EXAMPLES

Example 1

Figure 10:
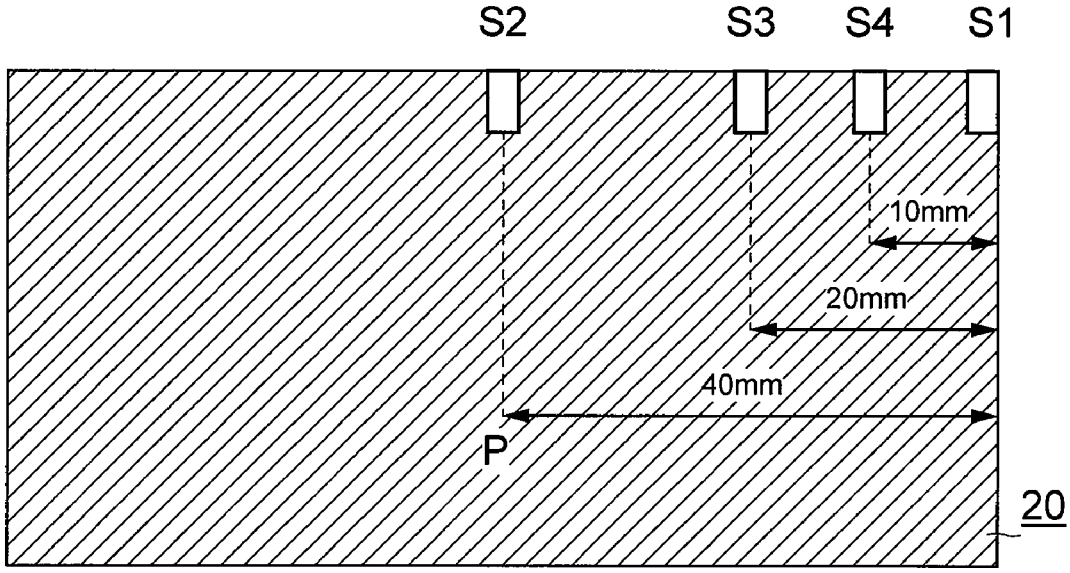
FIG. 10 is a schematic plan view showing the position of the antenna mounting area for explaining the measurement of the antenna characteristics when altering the position of the antenna mounting area.
Figure 11A:
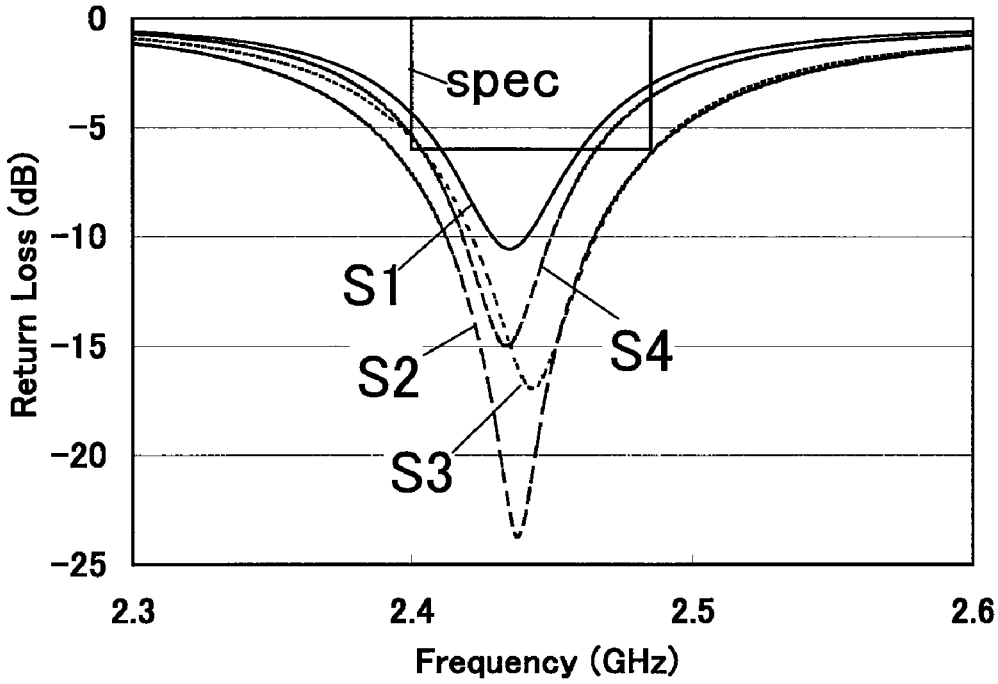
FIGS. 11A and 11B are graphs that show the results of the measurement of the antenna characteristics when altering the position of the antenna mounting area on the printed circuit board, specifically
Figure 11B:
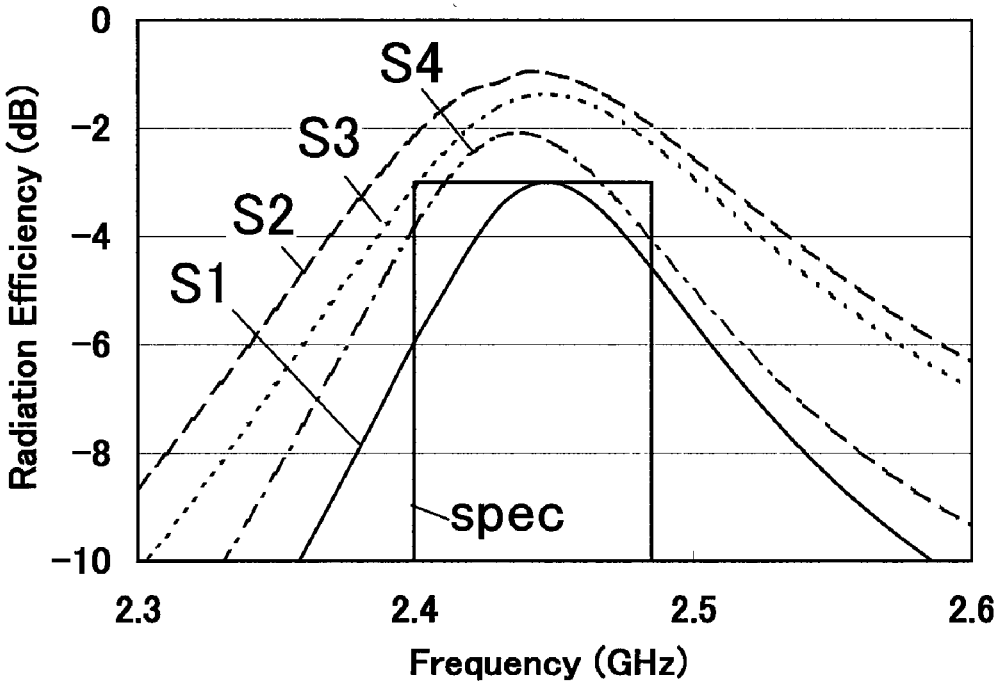

The antenna characteristics were measured while the position of the antenna mounting region was changed on the printed circuit board. The size of the printed circuit board was 80 mm×37 mm×1 mm, the size of the antenna mounting region was 3.0 mm×4.5 mm, and the chip size of the antenna element was 2.0 mm×1.2 mm×1.0 mm. As shown in FIG. 10, a sample S1 has the antenna mounting region located at the position of 50% from the reference point of the circuit board or at a corner portion of the circuit board, a sample S2 has the antenna mounting region located at the reference point (0%) of the circuit board, a sample S3 has the antenna mounting region located at the position of 25% from the reference point of the circuit board or at the mid point between the reference point and a corner portion, and a sample S4 has the antenna mounting region located at the position of 37.5% from the reference point of the circuit board or at the mid point between the antenna mounting region of the sample S1 and the antenna mounting region of the sample S3. The relative permittivity $\in_r$ of the base of the antenna element was 37, and the conductor patterns on the antenna element were adjusted so that the resonance frequency of each of the samples S1 to S4 became 2.43 GHz, and the input impedance became 50Ω. After that, signals between 2.3 GHz to 2.6 GHz were supplied through a signal line with the use of a network analyzer, and the return loss and radiation efficiency of the antenna device were measured. FIGS. 11A and 11B show the results of the measurement.

As shown in FIG. 11A, the return loss of each of the samples S1 to S4 becomes smallest at a frequency in the neighborhood of 2.43 GHz. Particularly, the sample S2 has the smallest return loss, followed by the sample S3, the sample S4, and the sample S1 in this order. Also, the graph shows that only the sample S2 is not included in the region defined by the borderline "spec" that determines whether the requirement for the return loss to be −6 dB or less in a desired frequency band is satisfied. The graph also shows that the sample S3 barely satisfies the requirement.

As shown in FIG. 11B, the radiation efficiency of each of the samples S1 to S4 becomes highest at a frequency in the neighborhood of 2.43 GHz. Particularly, the sample S2 has the highest radiation efficiency, followed by the sample S3, the sample S4, and the sample S1 in this order. The graph shows that only the sample S2 is not included in the region defined by the borderline "spec" that determines whether the requirement for the radiation efficiency to be −3 dB (50%) or higher in a desired frequency band is satisfied. The graph also shows that the sample S3 barely satisfies this requirement.

Example 2

Figure 12A:
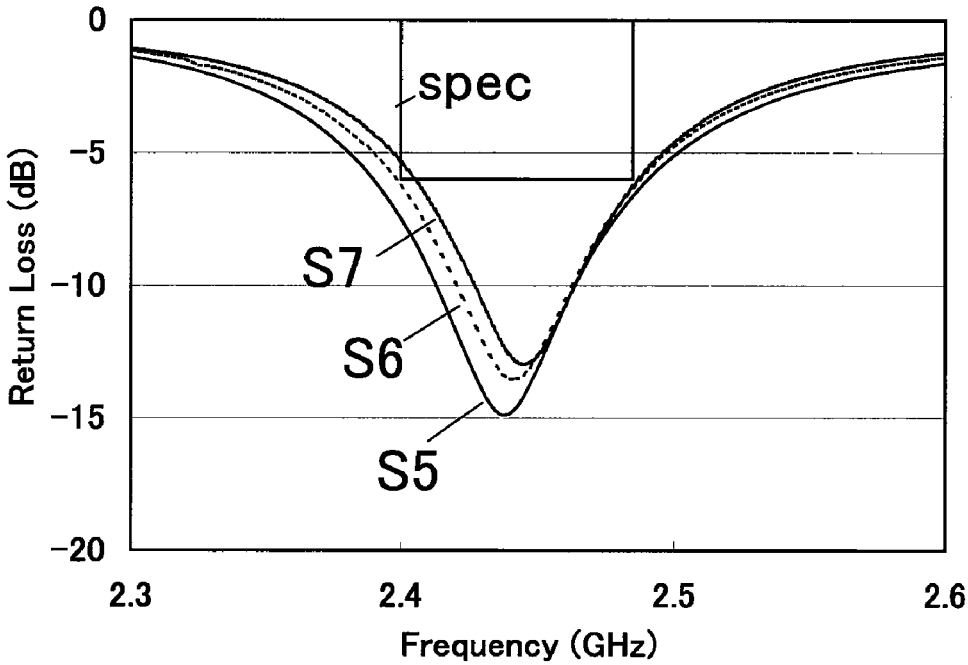
FIGS. 12A and 12B are graphs that show the results of the measurement of the antenna characteristics when altering the aspect ratio of the antenna mounting area, specifically
Figure 12B:
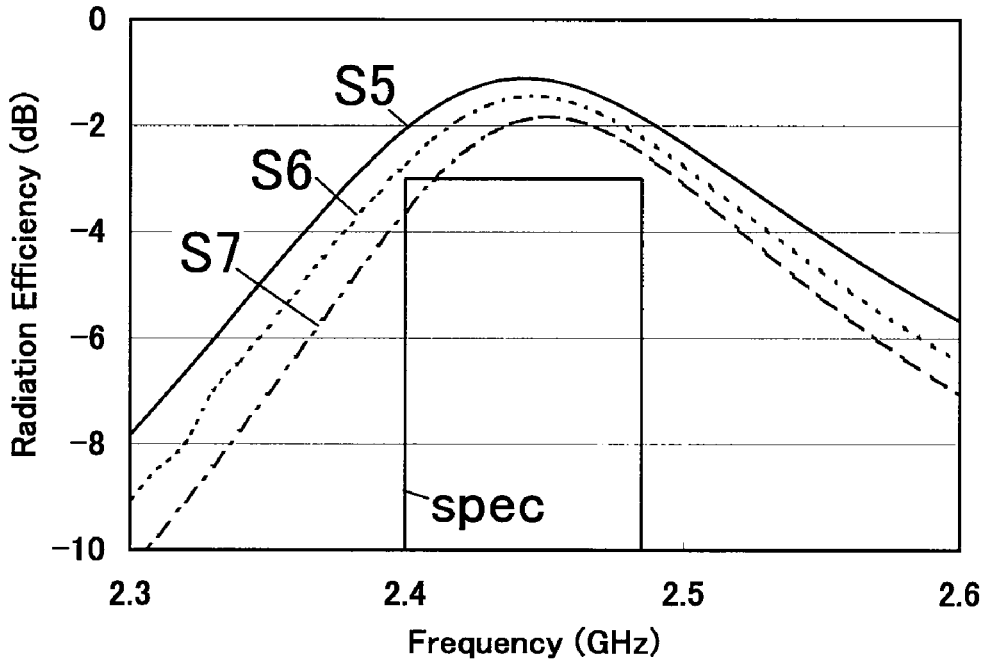

The antenna characteristics were measured while the aspect ratio of the antenna mounting region was varied. The size of the printed circuit board was 80 mm×37 mm×1 mm, and the antenna mounting region was located at the reference point (0%) in the longitudinal direction of the printed circuit board. The size (Wa×Wb, as shown in FIG. 5A) of the antenna mounting region was 3 mm×5 mm in a sample S5, 3 mm×4.5 mm in a sample S6, and 3 mm×4 mm in a sample S7. The chip size of the antenna element was 2.0 mm×1.2 mm×1.0 mm, and the relative permittivity $\in_r$ of the base of the antenna element was 37. The conductor patterns on the antenna element were adjusted so that the resonance frequency of each of the samples S5 to S7 became 2.43 GHz, and the input impedance became 50Ω. After that, signals between 2.3 GHz to 2.6 GHz were supplied through a signal line with the use of a network analyzer, and the return loss and radiation efficiency of the antenna device were measured. FIGS. 12A and 12B show the results of the measurement.

As shown in FIG. 12A, the return loss of each of the samples S5 to S7 becomes smallest at a frequency in the neighborhood of 2.43 GHz. Particularly, the sample S5 has the smallest return loss, followed by the sample S6 and the sample S7 in this order. Also, the graph shows that the samples S5 and S6 are not included in the region defined by the borderline "spec" that determines whether the requirement for the return loss to be −6 dB or less in a desired frequency band is satisfied. The graph also shows that the sample S7 cannot satisfy the requirement.

As shown in FIG. 12B, the radiation efficiency of each of the samples S5 to S7 becomes highest at a frequency in the neighborhood of 2.43 GHz. Particularly, the sample S5 has the highest radiation efficiency, followed by the sample S6 and the sample S7 in this order. The graph shows that the samples S5 and S6 are not included in the region defined by the borderline "spec" that determines whether the requirement for the radiation efficiency to be −3 dB (50%) or higher in a desired frequency band is satisfied. The graph also shows that the sample S7 cannot satisfy this requirement.

What is claimed is:

1. An antenna device comprising:

an antenna element; and a printed circuit board on which the antenna element is mounted, wherein the antenna element includes:

a base that is made of dielectric material and has substantially rectangular parallelepiped shape, said base includes a bottom surface and an opposing upper surface, the bottom surface facing the printed circuit board;

an inductance adjustment pattern that is formed on the upper surface and a side surface of the base and has a substantially U-shape;

a capacitance adjustment pattern that is formed on the upper surface of the base and is placed to face the inductance adjustment pattern via a gap with a predetermined width;

first and second terminal electrodes that are provided at one end of the bottom surface of the base in a longitudinal direction of the base; and a third terminal electrode that is provided at the other end of the bottom surface in the longitudinal direction of the base, the printed circuit board includes:

an insulating substrate;

an antenna mounting region that is a substantially rectangular insulating region provided on a surface of the insulating substrate in contact with an edge of a side of the insulating substrate;

a ground pattern that is formed on a surface of the insulating substrate so as to define three sides of the antenna mounting region excluding the side having the edge;

a feed line that is led into the antenna mounting region along the edge;

first to third lands that correspond to the first to third terminal electrodes, and are provided in the antenna mounting region; and a ground clearance region that is free of the inductance adjustment pattern, the capacitance adjustment pattern, and the ground pattern, and is formed on a bottom surface and an inner layer of the insulating substrate located immediately below the antenna mounting region, the antenna element is installed between a first side and a second side of the ground pattern that form two facing sides of the antenna mounting region, one end of the inductance adjustment pattern is connected to the feed line via the first terminal electrode and the first land, the other end of the inductance adjustment pattern is connected to the first side of the ground pattern on the side of the feed line via the second terminal electrode and the second land, wherein the first terminal electrode is closer to the edge than the second terminal electrode, and the third terminal electrode is connected to the second side of the ground pattern.

2. The antenna device as claimed in claim 1, wherein the inductance adjustment pattern includes:

a first conductor pattern that is formed on the upper surface of the base, and is positioned to face the capacitance adjustment pattern via the gap;

a second conductor pattern that is formed on a first side surface of the base perpendicular to the longitudinal direction of the base, the second conductor pattern includes one end connected to the first conductor pattern, and has the other end connected to the first terminal electrode; and a third conductor pattern that is formed on the first side surface of the base, the third conductor pattern includes one end connected to the first conductor pattern, and has the other end grounded, a loop formed with the first to third conductor patterns forms an inductance, and the inductance is adjustable by changing the shape of the loop.

3. The antenna device as claimed in claim 2, wherein the second and third conductor patterns are parallel to each other.

4. The antenna device as claimed in claim 3, wherein the first conductor pattern has a notch that is an extended portion of a space provided between the second conductor pattern and the third conductor pattern.

5. The antenna device as claimed in claim 2, wherein the capacitance adjustment pattern includes a substantially U-shaped conductor pattern that is formed along three sides of the upper surface of the base, the gap between the capacitance adjustment pattern and the first conductor pattern of the inductance adjustment pattern forms a capacitance, and the capacitance is adjustable by changing the shape of the capacitance adjustment pattern.

6. The antenna device as claimed in claim 5, wherein the capacitance adjustment pattern includes two strip conductor patterns that are parallel to longitudinal sides of the upper surface of the base, and open ends of the strip conductor patterns extend to an end portion of the base.

7. The antenna device as claimed in claim 5, wherein the capacitance adjustment pattern includes two strip conductor patterns that are parallel to longitudinal sides of the upper surface of the base, and open ends of the strip conductor patterns are located in more inside positions than an end portion of the base.

8. The antenna device as claimed in claim 1, wherein a direction of longitudinal sides of the antenna mounting region is perpendicular to a longitudinal direction of the printed circuit board, and an aspect ratio of the antenna mounting region is 1.5 or higher.

9. The antenna device as claimed in claim 1, wherein the antenna mounting region is placed within a range of ±25% from a center of the printed circuit board in a longitudinal direction of the printed circuit board.

* * * * *